US007497362B2

(12) United States Patent
Luciano et al.

(10) Patent No.: US 7,497,362 B2
(45) Date of Patent: Mar. 3, 2009

(54) PRINTER TEAR BAR AND PRESENTER SYSTEM

(75) Inventors: Robert A. Luciano, Reno, NV (US); Raymond G. Bryan, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 09/419,748

(22) Filed: Oct. 16, 1999

(65) Prior Publication Data

US 2002/0043546 A1 Apr. 18, 2002

(51) Int. Cl.
*B26F 3/00* (2006.01)

(52) U.S. Cl. ..... 225/93; 225/96; 225/100; 225/106

(58) Field of Classification Search ..... 225/2, 225/4, 5, 100, 106, 96.5, 96, 51, 52, 93, 94; 400/621

See application file for complete search history.

(56) References Cited

U.S. PATENT DOCUMENTS 2,252,733 A * 8/1941 Sherman et al. ..... 225/4
2,778,424 A * 1/1957 Hageman et al. ..... 225/100
2,803,304 A * 8/1957 Kessler ..... 225/4
3,727,814 A * 4/1973 Kuckhermann ..... 225/4
4,454,973 A * 6/1984 Irvine ..... 225/4
4,618,085 A * 10/1986 Kimura et al. ..... 225/4
4,865,241 A * 9/1989 Hamel ..... 225/4
4,946,086 A * 8/1990 Suuronen et al. ..... 225/4
5,076,555 A * 12/1991 Bunch, Jr. ..... 225/4
5,133,615 A * 7/1992 Saito et al. ..... 225/106
5,495,972 A * 3/1996 Nishishita et al. ..... 225/4
5,505,551 A * 4/1996 Rutherford ..... 400/621
5,687,545 A * 11/1997 Baker ..... 225/100
5,833,104 A * 11/1998 Horniak et al. ..... 225/106

* cited by examiner

*Primary Examiner*—Boyer D Ashley
*Assistant Examiner*—Omar Flores-Sánchez
(74) *Attorney, Agent, or Firm*—Ian F. Burns; Adam C. Ellsworth; Marvin A. Hein

(57) ABSTRACT

A printer tear bar and presenter system for printing on a strip of media and presenting a portion of the media to a user. The media comprises a plurality of perforations and a plurality of bridges of connecting material separating the perforations. The tear bar comprises first and second side portions and a center portion. The side portions and the center portions are adapted to abut the surface of the media so that friction creates stress on the bridges of connecting material. The first and second side portions are preferably tapered to concentrate tearing stress on corresponding bridges of connecting material. The printer and control circuitry are adapted to advance the media rapidly after the printer has finished printing to prevent users from pulling on the media prematurely.

14 Claims, 3 Drawing Sheets

PRINTER TEAR BAR AND PRESENTER SYSTEM

BACKGROUND OF THE INVENTION

1. Field of Invention

This invention relates to a printer tear bar and presenter system for separating a portion of a media from a strip of media and presenting it to a user.

2. Description of Related Art

Printers are now widely used to print on strips of media. Once the printer has printed information on a leading portion of a strip, the leading portion is separated from the strip of media to form a page, ticket, voucher, coupon or other printed object. For example, many receipt machines print on a strip of rolled paper. Once the printer has printed on the leading portion of the paper, the strip is advanced to a position where a receipt can be torn from the strip of paper.

Various devices have been developed for assisting the separation of the leading portion of the media from the strip of media. These include various tear bars and presenter systems. However, prior art tear bars and presenter system have suffered from a number of problems and disadvantages. One of the problems associated with prior art tear bars is that the tear bars fail to cleanly separate the leading portion of the media from the strip of media. This is a problem even with perforated media that is intended to separate into predefined portions. If a leading portion does not separate cleanly from a media it may tear subsequent portions of the media.

A problem associated with prior art presenter systems is that users tend to pull on media before the printer has completed printing. If the printing is not completely done, the voucher may be pulled through the printer, thereby deforming any information being printed on the voucher. It may also cause the media to be aligned incorrectly in the printer so that subsequent printing jobs are also printed incorrectly. If the user pulls hard enough, the media may be ripped, leaving part of the voucher in the printing machine. Clearing or resetting the printer may require inconvenient and expensive delays to its operation.

SUMMARY OF INVENTION

The present invention comprises a tear bar for assisting the separation of a piece of media from a strip of media. The strip of media comprises a surface, a first and second side, and a center portion. The tear bar comprises a first side portion and a second side portion. The first side portion is adapted to abut the surface of the strip of media adjacent to the first side of the strip of media and apply resistance on the strip of media when a longitudinal force is applied to the strip of media. Similarly, the a second side portion is adapted to abut the surface of the strip of media adjacent to the second side of the strip of media and apply resistance on the strip of media when a longitudinal force is applied to the strip of media.

The media may also comprise a plurality of perforations. The plurality of perforations are separated by a plurality bridges of connecting material. The perforations may be positioned in substantially a line.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENT

Figure 1:
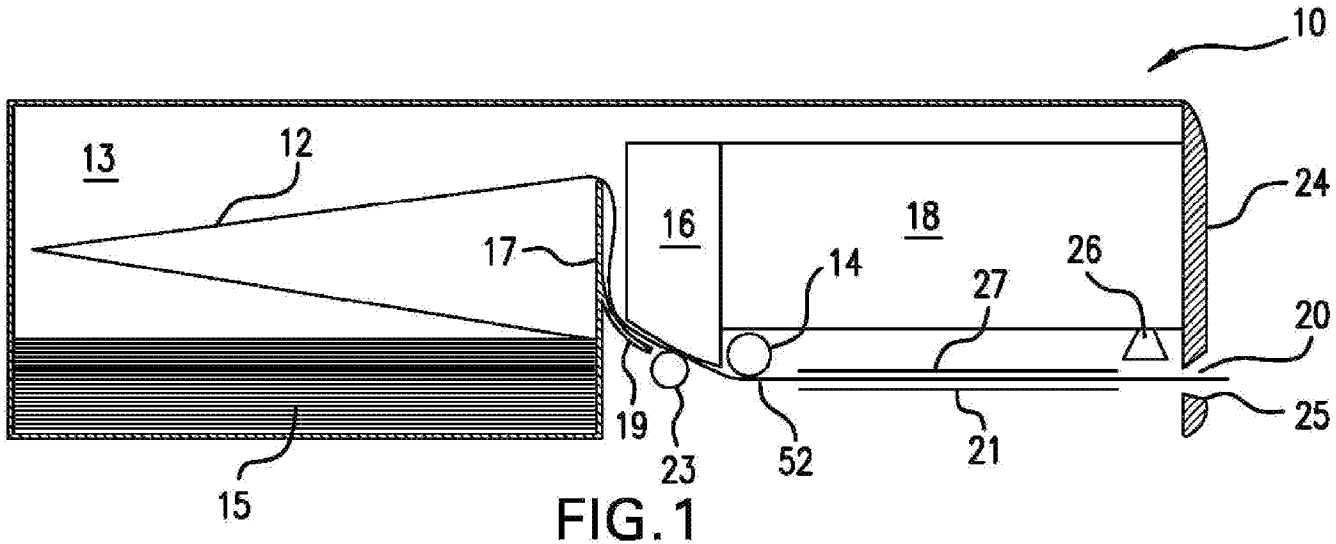
FIG. 1 is substantially a schematic side view of the tear bar and presenter system of the present invention.

Referring now to FIG. 1, the present invention comprises a tear bar and presenter system generally indicated by reference number 10. System 10 comprises a strip of media 12. Media 12 is adapted to be printed on by a printer and separated into individual pieces. Media 12 is flexible enough to be thread through the printing and presenting systems of the present invention. Once printed and separated from the strip, individual pieces of media may be used as tickets, vouchers, coupons, and other information carrying objects.

Media 12 is stored in a media bin or holder 13. In the preferred embodiment, media 12 is fan-folded and a folded stack 15 is stored in bin 13. In other embodiments, media 12 is rolled, in which case means is provided for holding a roll of media and unrolling it to dispense the media. Fan folded media, however, has the advantage of producing relatively flat vouchers and occupying less space in the presently preferred embodiment.

Figure 2:
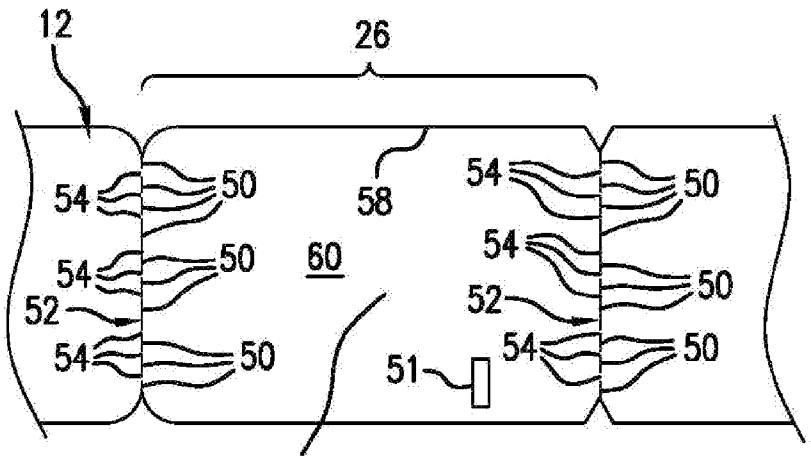
FIG. 2 is substantially a top plan view of the media of the present invention.

Turning now to FIG. 2, media 12 of the present invention comprises a surface 60, first side 56, a second side 58, and a central portion 62. A plurality of perforations 50 are provided on media 12 for assisting the separation of pieces of media from each other. Perforations are preferably arranged in lines 52 that are parallel to the lateral axis of the media. Distance 26 between lines 52 is substantially the length of each voucher that may be removed from media 12. One of the advantages of the preferred embodiment is that lines 52 provide a convenient location to fan fold media 12. However, it is recognized that other perforation configurations may also be used with the present invention. For example, lines 52 may be placed at an angle to the lateral axis of the media with corresponding adjustments being made to system 10.

Perforations 50 are separated by at least one bridge of connecting material 54. In the preferred embodiment, three groups of three bridges are provided in each line 52. A first group is positioned in close relative proximity to the first side 56, a second group is positioned in close relative proximity to the second side 58, and a third group is positioned in central portion 60. It has been found that this configuration provides enough bridges of connective material to allow media 12 to be pulled from bin 13 without breaking and yet the individual pieces of media may be easily separated from the strip of media. Other bridge configurations may also be used with the present invention. For example, only two bridges may be utilized.

Media 12 may also comprises chamfered corners 64 at each line 52. When an individual voucher is removed from media 12, it has a chamfer 64 on each of its corners. Chamfers 64 allow individual vouchers to be inserted more easily into other equipment, such as a voucher reader or validator, and it allows media 12 to be more easily threaded into system 10. Chamfers 64 may also be used with a sensor to detect the position lines 52. This may be used to accurately position media 12 and to ensure that information for a particular voucher is being printed entirely on that voucher. The chamfers may be formed in a number of shapes. For example, the chamfers may be single angular lines, multiple angular lines, curves, or other comer treatments. Media 12 may be made by a number of different manufacturers including Lottery Impressions, Inc. of Waterford, Mich.

Media 12 may also comprise optical reference marker for use with an optical sensor to accurately position the media. In the preferred embodiment, media 12 is repositioned before each printing job to correct for any slippage or error.

Returning now to FIG. 1, media 12 is fed out of bin 13 over wall 17. Wall 17 may have guide portion 19 that guides media 12 to printer 16. This may be especially useful when media 12 is first being threaded into printer 16.

Printer 16 is adapted to print information on the media 12 as it is advanced past the printer. Drive wheel 23 may be provided for advancing media 12 through system 10. Drive wheel 23 maybe apart of printer 16.

A large variety of information may be printed on the media 12 and the information may be presented in a number of different ways. For example, the information may be relevant to financial transactions, games, coupons, and prizes, and the information may be presented in alphabetical or numerical characters, symbols, or bar codes. Printer 16 is preferably a LabelWriter SE available from Costar Corporation in Greenwich, Conn. The entire printer assembly, including printer 16 and controller 18 is preferably a Series 700 printer assembly available from TransAct Technologies, Inc., of Wallingford, Conn. However, a large variety of other printers may also be used. It is understood that printer 16 may imprint ink or similar dye onto media 12, it may change a property of the media to create visible characters (e.g., heating the media), it may form holes through the media to render it machine readable, or it may code magnetic information onto a magnetic strip or the like on the media.

A printer controller 18 is provided for controlling printer 16. Controller 18 may be mechanical or electronic depending on the type of printer. Controller 18 may perform other functions, such as controlling lights and communicating with other devices, such a computer or gaming device.

As media 12 is advanced, it is fed underneath a tear bar 14 and controller 18 through opening 20. One or more guides 21 may be provided for guiding media 12 along this path. Opening 20 is the front of the machine where media 12 is presented to a user. Media 12 is advanced so that line 52 is positioned next to tear bar 14. In the preferred embodiment, tear bar 14 is positioned a predetermined distance from opening 20 so that approximately one-half inch of media 12 is advanced past the opening. It has been found that presenting approximately one-half inch of media 12 to a user substantially reduces the likelihood that a user will prematurely grasp and pull the media. This reduces the chance that a voucher will be printed incorrectly due to slippage and acceleration.

The configuration of system 10 provides that a voucher is completely printed and line 52 is past printer 16 before any of the media is exposed to the user. This prevents a user from grasping and pulling media 12 until after printer 16 has finished printing. Of course, the spatial relationship of printer 16, tear bar 14, and opening 20 is dependent on the distance 26 between lines 52 of media 12.

System 10 may also comprise bezel 24 to provide an attractive appearance to users and to limit access to opening 20. A recess 25 may be provided in bezel 24 to allow users to insert their fingers to grasp media 12.

Light source 26 may be provided near media 12 in a position adjacent to opening 20 to illuminate media 12. Light source 26 may be activated by controller 18 when media 12 is available for a user to grasp. Light source 26 may prevent a user from prematurely grasping and pulling on media 12 because the users attention is brought to the media only after the media has been properly positioned.

The present invention also provides means for advancing media 12 rapidly so that it is more difficult for users to grasp the media until it is in a proper position. During a printing operation, media 12 is generally advanced relatively slowly to accommodate printer 16. However, if media 12 is advanced at this rate slow rate when the media begins to extend out of opening 20, then it is possible for users to grasp the media and pull on the media before it has reached its fully extended position. To counter this, the present invention advances media 12 at a higher rate after printer 16 has finished printing.

Figure 3:
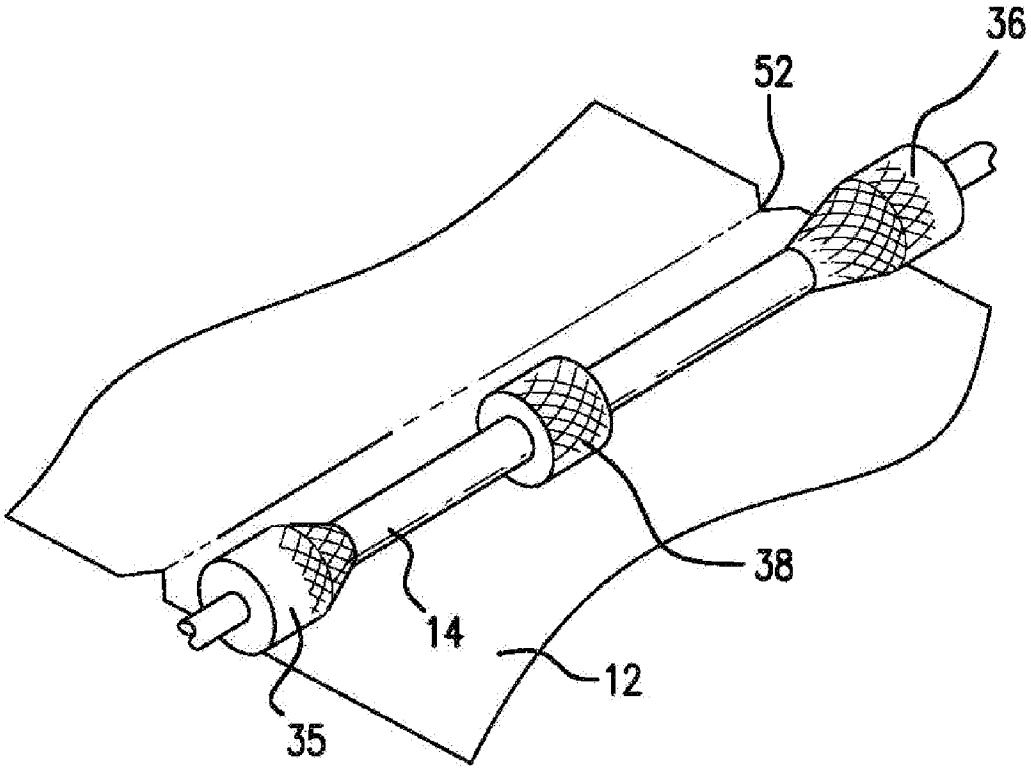
FIG. 3 is substantially an isometric view of the tear bar of the present invention in use with media of the present invention.
Figure 4:
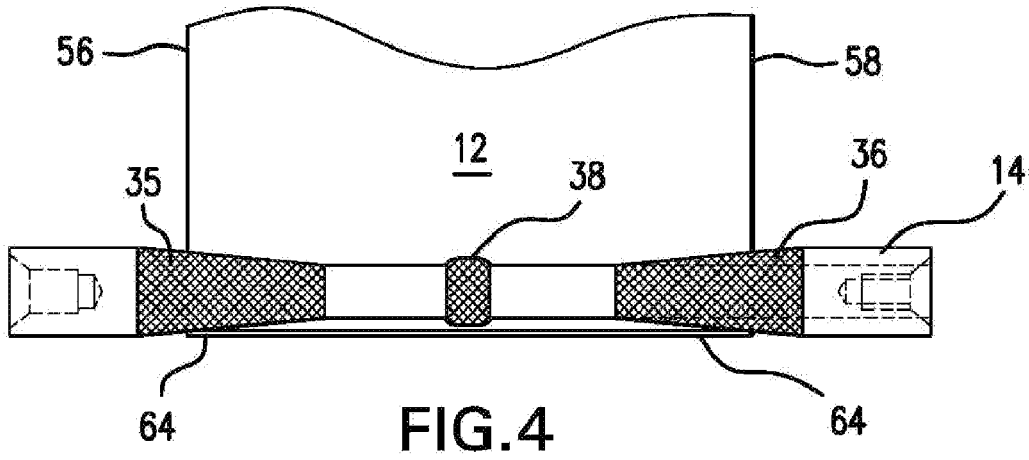
FIG. 4 is substantially a front plan view of the tear bar of the present invention in use with media of the present invention.

Turning now to FIGS. 3, and 4, tear bar 14 is provided for assisting the separation of a voucher from media 12. Tear bar 14 comprises a first side portion 35, a second side portion 36 and a central portion 38. First side portion 35 is adapted to abut surface 60 adjacent to first side 56. Second side portion 36 may is adapted to abut surface 60 adjacent to second side 58. Center portion 38 is located between first and second side portions 35 and 36 and it is adapted to abut surface 60 at center portion 62. In the preferred embodiment, the three groups of three bridges 54 roughly correspond to the positions of first side portion 35, second side portion 36, and center portion 38. Thus, when a pulling force is applied by a user to media 12, first and second side portions 35 and 36 and center portion 38 provide friction and stress is applied to bridges 54.

First side portion 35 may be provided with tapered surfaces so that its height or thickness decreases as the portion is traversed from the first side towards the center of tear bar 14. Similarly, second side portions 35 may be provided with tapered surfaces so that its height or thickness decreases as the portion is traversed from the second side towards the center of tear bar 14. This configuration tends to concentrate stress on a single outer bridge 54 rather than a plurality of bridges when a pulling force is applied. When stress is concentrated on a single bridge 54, the bridge tends to break more quickly and cleanly. Once the outer most bridge 54 breaks, stress is transferred to the next bridge until it breaks. This configuration also works well when users who produce a torque by pulling on a comer of media 12 because the torque tends to concentrate the stress even more on an outer bridge 54.

First and second side portions 35 and 36 and center portion 38 may have roughened surfaces to produce more friction. The roughened surface may be produced by knurling, diamond coating, or by other means that are well known in the art. The roughened surfaces help keep the media in place when a pulling force is applied thereby creating stress on bridges 54 and it helps keep the next piece of un-printed media stationary.

Figure 5:
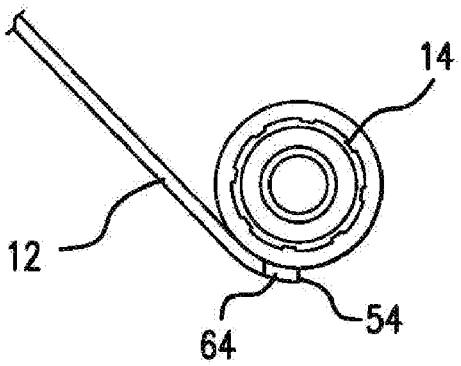
FIG. 5 is substantially a left side elevational view of the tear bar of the present invention.
Figure 6:
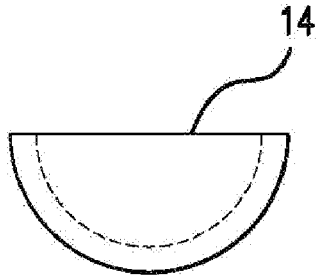
FIG. 6 is substantially a left side elevational view of an alternative embodiment of the tear bar of the present invention.

As seen in FIG. 5, in the preferred embodiment tear bar 14 has a substantially round cross-section. The tear bar is mounted in system 10 so that the bar does not rotate. Other configurations may also be utilized. For example, as seen in FIG. 6, tear bar 14 may have a partially circular cross-section.

Figure 7:
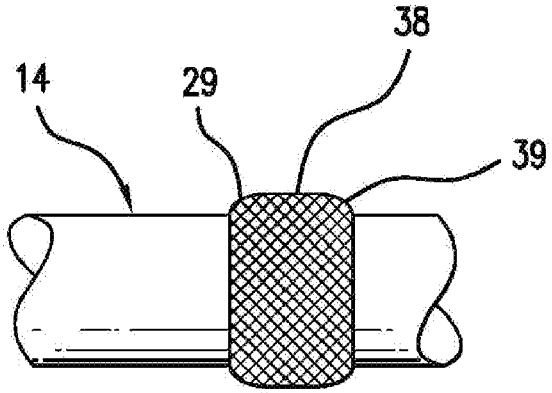
FIG. 7 is substantially a detailed view of the center portion of the tear bar of the present invention.

Turning now to FIG. 7, center portion 38 has a height that is greater than surrounding portions of tear bar 14. The edges of center portion 38 may have rounded or tapered portions 39 to provide the stress concentrating effect discussed above.

Tear bar 14 is shown as rod or shaft-like member. This provides a convenient form for manufacturing tear bar 14. However, it is recognized that tear bar 14 may be formed from other objects. For example, tear bar 14 could be formed from a substantially planar object by forming first and second side portions 35 and 36 and center portion 38 into the surface of the planar object. If the planar object is sheet metal, the first and second side portions 35 and 36 and center portion 38 may be formed by pressing protrusions into the sheet metal.

SUMMARY

Although the description above contains many specifications, these should not be construed as limiting the scope of the invention but as merely providing illustrations of some of presently preferred embodiments of this invention. Thus, the scope of the invention should be determined by the appended claims and their legal equivalents rather than by the examples given.

What is claimed is:

1. A tear bar for assisting the separation of a piece of media from a strip of media, the strip of media having a surface, a first and second side, and a center portion, the tear bar comprising:

(A) a first side portion, the first side portion being adapted to abut the surface of the strip of media adjacent to the first side of the strip of media and apply resistance on the strip of media when a longitudinal force is applied to the strip of media; and (B) a second side portion, the second side portion being adapted to abut the surface of the strip of media adjacent to the second side of the strip of media and apply resistance on the strip of media when a longitudinal force is applied to the strip of media;

wherein the tear bar is formed from an integrally formed member having a substantially semi-circular lateral cross-section, the integrally formed member further having a center portion between the first side portion and the second side portion, the center portion having a diameter less than the first side portion and the second side portion, and wherein at least one of the first or second side portions comprises a roughened surface.

2. The tear bar of claim 1 wherein the first side portion comprises a tapered surface, wherein the height of the first side portion decreases as the first side portion is traversed from the first side of the strip of media towards the center of the strip of media.

3. The tear bar of claim 1 wherein the second side portion comprises a tapered surface, wherein the height of the second side portion decreases as the second side portion is traversed from the second side of the strip of media towards the center of the strip of media.

4. The tear bar of claim 1 further comprising a center portion between the first and second side portions, the center portion being adapted to abut the surface of the strip of vouchers in the center portion of the strip of vouchers and apply resistance on the strip of vouchers when a longitudinal force is applied to the strip of vouchers.

5. The tear bar of claim 4 wherein the center portion comprises a roughened surface.

6. The tear bar of claim 4 wherein the center portion comprises a rounded surface.

7. The tear bar of claim 1, wherein the tear bar remains in a fixed position during feeding and separation of the strip of media.

8. A tear bar for assisting the separation of a piece of media from a strip of media, the strip of media having a surface, a first and second side, and a center portion, the tear bar comprising:

(A) a first side portion, the first side portion being adapted to abut the surface of the strip of media adjacent to the first side of the strip of media and apply resistance on the strip of media when a longitudinal force is applied to the strip of media;

(B) a second side portion, the second side portion being adapted to abut the surface of the strip of media adjacent to the second side of the strip of media and apply resistance on the strip of media when a longitudinal force is applied to the strip of media; and (C) a center portion between the first side portion and the second portion, the center portion having a diameter less than the first side portion and the second side portion, wherein the tear bar remains in a fixed position during feeding and separation of the strip of media, wherein at least one of the first or second side portions comprises a roughened surface.

9. The tear bar of claim 8, further comprising a center portion between the first and second side portions, the center portion being adapted to abut the surface of the strip of media when a longitudinal force is applied to the strip of media.

10. The tear bar of claim 9, wherein the center portion comprises a roughened surface.

11. The tear bar of claim 9, wherein the center portion comprises a rounded surface.

12. A tear bar for assisting the separation of a piece of media from a strip of media, the strip of media having a surface, a first and second side, and a center portion, the tear bar comprising:

(A) a first side portion, the first side portion being adapted to abut the surface of the strip of media adjacent to the first side of the strip of media and apply resistance on the strip of media when a longitudinal force is applied to the strip of media;

(B) a second portion, the second side portion being adapted to abut the surface of the strip of media adjacent to the second side of the strip of media and apply resistance on the strip of media when a longitudinal force is applied to the strip of media; and (C) a center portion between the first and second side portions, the center portion having a diameter less than the diameter of the first side portion and the diameter of the second side portion the center portion being adapted to abut the surface of the strip of media when a longitudinal force is applied to the strip of media wherein the center portion comprises either a roughened surface or a rounded surface.

13. The tear bar of claim 12, wherein at least one of the first or second side portions comprises a roughened surface.

14. The tear bar of claim 12, wherein the tear bar remains in a fixed position during feeding and separation of the strip of media.

* * * * *

UNITED STATES PATENT AND TRADEMARK OFFICE

CERTIFICATE OF CORRECTION

PATENT NO. : 7,497,362 B2
APPLICATION NO. : 09/419748
DATED : March 3, 2009
INVENTOR(S) : Robert A. Luciano, Jr. and Raymond G. Bryan It is certified that error appears in the above-identified patent and that said Letters Patent is hereby corrected as shown below:

Column 1
In line 52, delete “a”
In line 58, before “bridges” insert --of--

Column 3
In line 10, replace “comprises” with --comprise--
In line 36, insert a space after “may”
In line 36, replace “apart” with --a part--
In line 58, insert --as-- after “such”

Column 4
In line 28, delete “rate”, first occurrence
In line 38, delete “may” after “36”

Signed and Sealed this

Twenty-eighth Day of April, 2009

John Doll

JOHN DOLL
*Acting Director of the United States Patent and Trademark Office*